US009513093B1

(12) United States Patent
Steinman et al.

(10) Patent No.: US 9,513,093 B1
(45) Date of Patent: Dec. 6, 2016

(54) ARROW MOUNTED TRACKING APPARATUS

(71) Applicant: IRON MOUNTAIN PRODUCTS, LLC, Lecompton, KS (US)

(72) Inventors: Dennis Steinman, Lecompton, KS (US); Dennis A. Falls, Olathe, KS (US); Alexander J. Waller, Olathe, KS (US)

(73) Assignee: Iron Mountain Products, LLC, Lecompton, KS (US)

( * ) Notice: Subject to any disclaimer, the term of this patent is extended or adjusted under 35 U.S.C. 154(b) by 0 days.

(21) Appl. No.: 15/152,318

(22) Filed: May 11, 2016

Related U.S. Application Data

(60) Provisional application No. 62/159,676, filed on May 11, 2015, provisional application No. 62/273,935, filed on Dec. 31, 2015.

(51) Int. Cl.
*F42B 6/04* (2006.01)
*F42B 12/38* (2006.01)
*F42B 6/08* (2006.01)

(52) U.S. Cl.
CPC ..... *F42B 12/385* (2013.01); *F42B 6/04* (2013.01); *F42B 6/08* (2013.01)

(58) Field of Classification Search
CPC ..... F42B 6/04; F42B 6/08; F42B 12/385
See application file for complete search history.

(56) References Cited

U.S. PATENT DOCUMENTS 7,300,367 B1 * 11/2007 Andol ..... F42B 12/385 342/385
7,331,887 B1 * 2/2008 Dunn ..... F42B 12/385 455/98
7,632,199 B2 * 12/2009 Kikos ..... F42B 12/385 473/578
8,192,309 B1 * 6/2012 Roberts ..... F42B 12/385 473/578
8,393,982 B2 * 3/2013 Ferguson ..... F42B 12/385 473/578
8,425,354 B2 * 4/2013 Ferguson ..... F42B 6/04 473/578
9,062,947 B1 * 6/2015 Patel ..... F42B 12/385

* cited by examiner

*Primary Examiner* — John Ricci
(74) *Attorney, Agent, or Firm* — Hovey Williams LLP

(57) ABSTRACT

An animal tracking device comprising a housing, a controller, a battery, an antenna, a sleeve, an elastic ring, and a prong. The housing encloses the controller and the battery and includes a flexible clip having a flexible neck, a latch on an inner side of the flexible clip, an elastic ring groove on an outer side of the flexible clip for receiving the elastic ring, and a latch release member extending from the outer side between the flexible neck and the elastic ring groove. The elastic ring retains the housing over the sleeve to retain the animal tracking device on an arrow shaft. The latch release member catches on an animal's hide and flexes the flexible clip out of engagement with the sleeve to release the animal tracking device from the arrow shaft. The prong embeds in the animal's hide and retains the animal tracking device on the animal.

20 Claims, 5 Drawing Sheets

ARROW MOUNTED TRACKING APPARATUS

RELATED APPLICATIONS

This patent application is a non-provisional regular utility patent application and claims priority benefit with regard to all common subject matter of earlier-filed U.S. Provisional Patent Application No. 62/159,676, filed May 11, 2015, and entitled "ARROW MOUNTED TRACKING APPARATUS" and U.S. Provisional Patent Application No. 62/273,935, filed Dec. 31, 2015, and entitled "ARROW MOUNTER TRACKING APPARATUS". The identified earlier filed provisional patent applications are hereby incorporated by reference in their entireties into the present application.

BACKGROUND

Game animals often run or move for considerable distances after being shot by bow hunting arrows, which means hunters often have to track the game animals for long distances before the game animals expire or become exhausted. To that end, animal tracking devices mounted on the arrows are often used for tracking game animals after the arrows hit the game animals. However, the arrows sometimes pass through the game animals' hides entirely, fall out of the game animals, or break off, which results in the animal tracking devices being left behind as the game animals run off. In these instances, hunters must then track the game animals conventionally. Animal tracking devices are also difficult to mount onto arrows, and improperly mounted animal tracking devices may fall off the arrows in flight or may cause the arrows to become unbalanced and miss their target.

SUMMARY

Embodiments of the invention solve the above-mentioned problems and provide a distinct advance in the art of animal tracking devices. More particularly, the invention provides an arrow mountable animal tracking device configured to detach from an arrow and attach to a game animal's hide so that the game animal can be tracked even if the arrow does not remain embedded in the game animal. The animal tracking device may be mounted on an arrow via an assembling tool to ensure the animal tracking device is mounted properly on the arrow.

An embodiment of the animal tracking device comprises a housing, a controller, a battery, an antenna, a sleeve, an elastic ring, and a prong. The housing encloses the controller and the battery and includes a flexible clip having a flexible neck, a latch on an inner side of the flexible clip, an elastic ring groove on an outer side of the flexible clip for receiving the elastic ring, and a latch release member extending from the outer side between the flexible neck and the elastic ring groove.

The controller generates a tracking signal for allowing the hunter to track a tagged game animal. The antenna extends from the housing and transmits the tracking signal. The sleeve releasibly retains the housing on the arrow shaft and comprises a primary body, an opening extending through the primary body for positioning the sleeve on the arrow shaft, a catch extending form the primary body for releasibly engaging the latches of the flexible clip, and an elastic ring guide for retaining the elastic ring in engagement with the flexible clip. The elastic ring is configured to be positioned in the elastic ring guide and aligned with the elastic ring groove of the flexible clip for resistively retaining the latch in engagement with the catch of the sleeve. The prong extends forward from the housing for piercing the game animal's hide and may include a rear-facing barb for attaching the animal tracking device to the game animal.

The latch release member is configured to catch on the game animal's hide when the arrow hits the game animal and slightly bend the flexible clip at the flexible neck against a resistive force exerted by the elastic ring until the latch of the flexible clip clears the catch of the sleeve. This frees the housing from engagement with the sleeve and allows the housing to remain attached to the game animal's hide even if the arrow continues through and does not remain embedded in the game animal. The animal tracking device ensures that the game animal can be tracked after being shot even if the arrow does not stay with the game animal.

The animal tracking device has a balanced weight distribution and an aerodynamic profile to minimize its effect on the arrow's flight path. For example, the controller compartment and the battery compartment of the housing straddle the arrow on opposite sides of the arrow shaft to evenly distribute the weight of the electronic components. The animal tracking device may also include two identical or similar prongs and flexible clips for increasing the symmetry, and hence the balance, of the animal tracking device.

Another embodiment of the animal tracking device comprises a housing, a controller, a battery, an antenna, a sleeve, an elastic ring, and a number of prongs. The housing includes a first section having a controller compartment, a second section having a battery compartment, a connecting member extending between the first section and the second section, and at least two flexible clips spaced from each other. The flexible clips each include a flexible neck, a latch on an inner side, an elastic ring groove on an outer side for receiving the elastic ring, and a latch release member extending from the outer side between the flexible neck and the elastic ring groove.

The controller is positioned in the controller compartment and generates a tracking signal for allowing the hunter to track a tagged game animal. The antenna extends from the housing and transmits the tracking signal. The sleeve releasibly retains the housing on the arrow shaft and comprises a primary body, an opening extending through the primary body for positioning the sleeve on the arrow shaft, a number of catches extending form the primary body for releasibly engaging the latches of the flexible clips, and elastic ring guides for retaining the elastic ring in engagement with the flexible clips. The elastic ring is configured to be positioned in the elastic ring guides and aligned with the elastic ring grooves of the flexible clips for resistively retaining the latches in engagement with the catches of the sleeve. The prongs extend forward from the housing for piercing the game animal's hide and may include rear-facing barbs for attaching the animal tracking device to the game animal.

The latch release members are configured to catch on the game animal's hide when the arrow hits the game animal and slightly bend the flexible clip at the flexible neck against a resistive force exerted by the elastic ring until the latch of the flexible clears the catch of the sleeve. This frees the housing from engagement with the sleeve and allows the animal tracking device to remain attached to the game animal's hide even if the arrow does not remain embedded in the game animal.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the preferred embodiments and the accompanying drawing figures.

BRIEF DESCRIPTION OF THE DRAWINGS

Embodiments of the invention are described in detail below with reference to the attached drawing figures, wherein.

Figure 1:
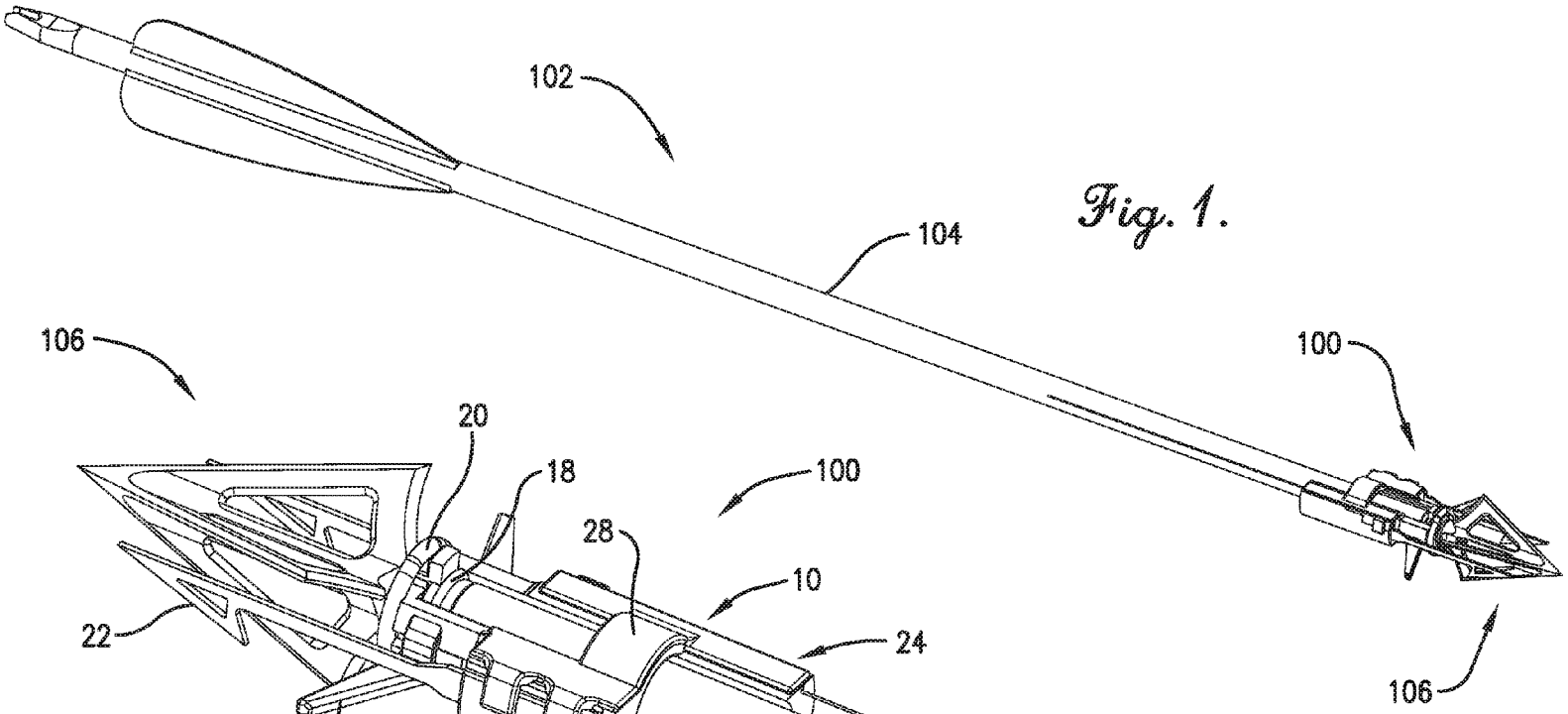
FIG. 1 is a perspective view of an animal tracking device mounted on an arrow and constructed in accordance with an embodiment of the invention.
Figure 2:
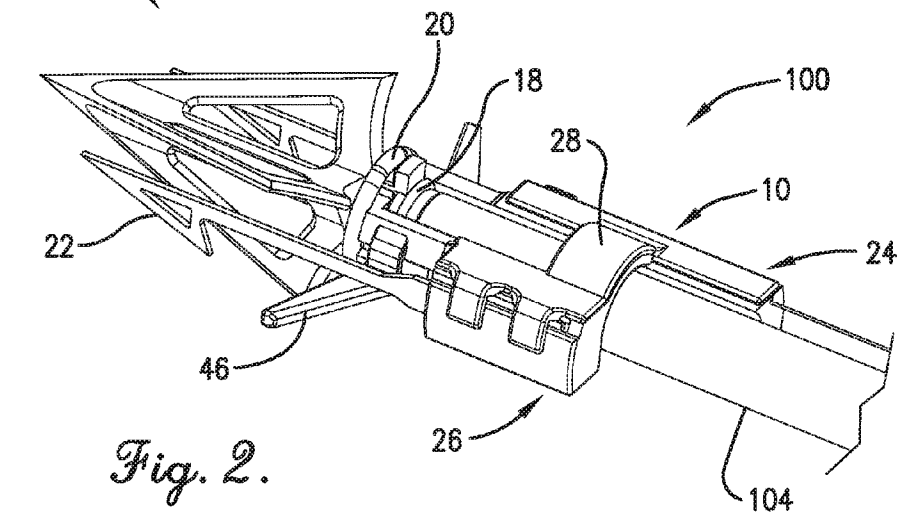
FIG. 2 is a perspective view of the animal tracking device of FIG. 1.
Figure 3:
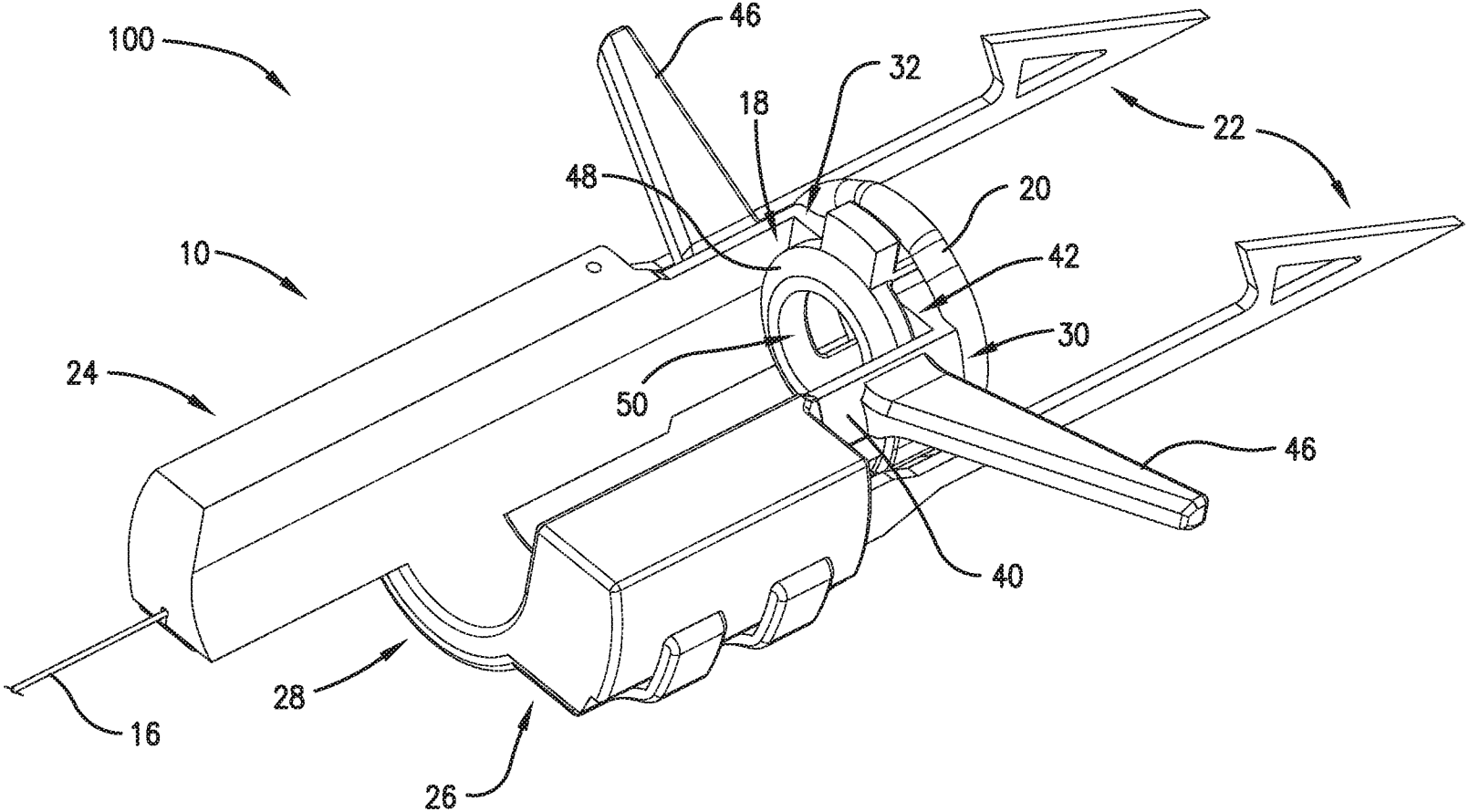
FIG. 3 is an enlarged perspective view of the animal tracking device of FIG. 1.
Figure 4:
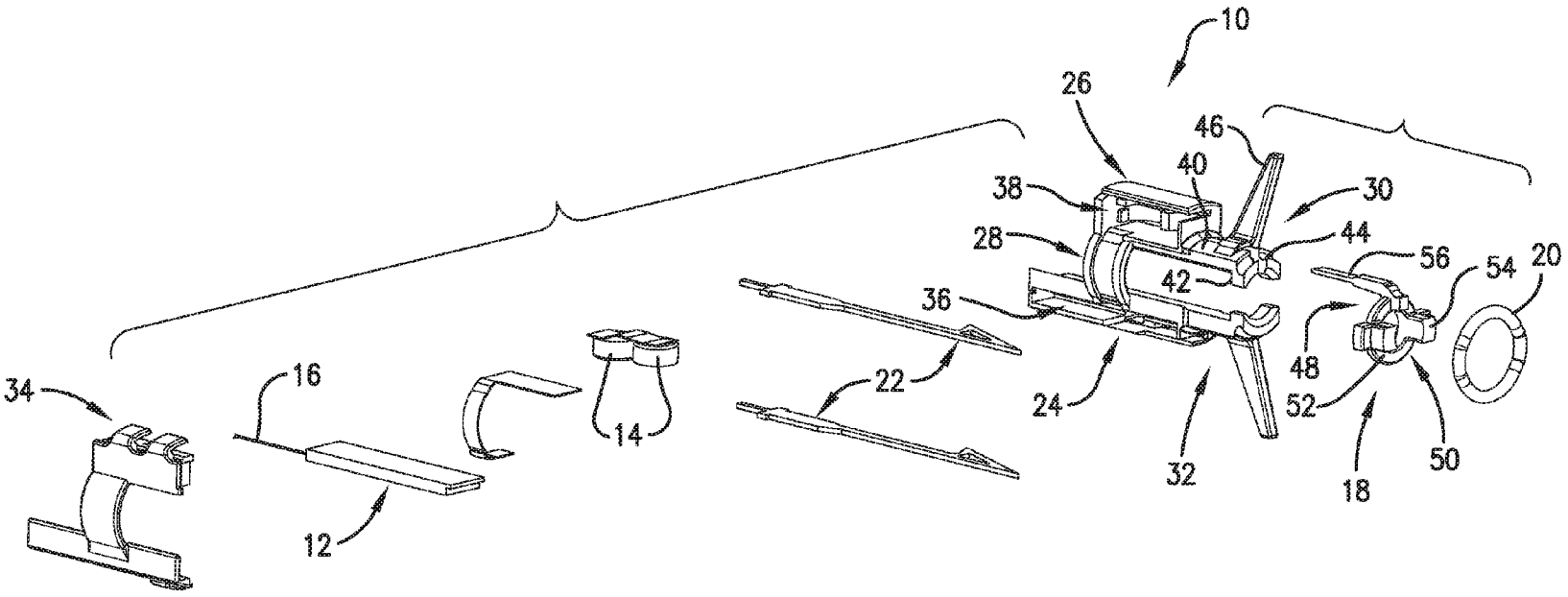
FIG. 4 is an assembly view of the animal tracking device of FIG. 1.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention may be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment", "an embodiment", or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

Turning to the drawing figures, an animal tracking device 100 and an assembling tool 200 constructed in accordance with an embodiment of the invention are illustrated. The animal tracking device 100 allows a hunter to track a game animal that he has shot with an arrow 102 and broadly comprises a housing 10, a controller 12, a battery 14, an antenna 16, a sleeve 18, an elastic ring 20, and a number of prongs 22, as shown in FIGS. 1-4.

The housing 10 protects the controller 12 and battery 14 and comprises a first section 24, a second section 26 spaced from the first section 24, a connecting member 28 extending between the first section 24 and the second section 26, a first flexible clip 30 extending from a first end of the housing 10, and a second flexible clip 32 extending from the first end of the housing 10 and spaced from the first flexible clip 30. The housing 10 may also include a wire cover 34 and/or compartment caps for enclosing the controller 12, battery 14, wires or circuit connecting elements, and other components in the housing 10. The first section 24 includes a controller compartment 36 for housing the controller 12. The second section 26 includes a battery compartment 38 for housing the battery 14. The connecting member 28 connects the first section 24 and the second section 26 together and may include wire grooves, channels, or through-holes for battery wires extending between the controller 12 and the battery 14 or other circuit wires or electronic components. The connecting member 28 may be curved or semi-circular for following an outer contour of the arrow shaft 104. The first section 24, second section 26, and connecting member 28 may form a C-shape such that the housing 10 can be positioned close to the arrow shaft 104. In one embodiment, the housing 10 may be shaped so that the center of mass of the animal tracking device 100 is near or coincides with a central axis of the arrow 102 when the animal tracking device 100 is positioned on the arrow shaft 104. The housing may be formed of molded plastic, lightweight metal, wood, or any other suitable material.

The flexible clips 30, 32 engage the sleeve 18 and may each comprise a flexible neck 40, an inner side including a latch 42, an outer side having an elastic ring groove 44, and a latch release member 46. For simplicity, only flexible clip 30 will be discussed. The flexible neck 40 allows the flexible clip 30 to bend away from the arrow shaft 104 and may be formed of a flexible material and/or may have a sufficiently small cross section so as to be relatively compliant. The latch 42 engages a catch of the sleeve 18 (described below) and may be a small protrusion, tab, or other similar member. The latch 42 may have a height such that outward bending of the flexible clip 30 is sufficient to disengage the latch 42 from the clip, as described in more detail below.

The elastic ring groove 44 retains the elastic ring 20 over the flexible clip 30 and may be a shallow recess or channel. The elastic ring groove 44 should be sufficiently shallow to allow the flexible clip 30 to slip out of engagement with the elastic ring 20 when the flexible clip 30 disengages from the sleeve 18 or deep enough to retain the elastic ring 20 and stretch the elastic ring 20 out of engagement with the sleeve 18. Importantly, the elastic ring groove 44 should be deep enough so that the elastic ring 20 does not slip out of engagement from the flexible clip 30 until the animal tracking device 100 attaches to the game animal.

The latch release member 46 catches against the game animal's hide and may be an elongated member extending outward from the flexible clip 30. The latch release member 46 may be positioned in front of the flexible neck 40 so that the latch release member 46 will have leverage to bend the flexible neck 40. The latch release member 46 may extend diagonally forward to optimize leverage forces acting on the latch release member 46 and bending the flexible neck 40 outward.

The controller 12 generates a beacon or tracking signal and may be a printed circuit board or simple circuit positioned in the controller compartment 36 of the housing 10.

The controller 12 may generate different signals based on criteria such as distance from the hunter or other object, position based on a GPS location, amount of time lapsed from an initial signal transmission or activation, remaining battery life, or any other suitable criteria. The controller 12 may be programmable and may have inputs for receiving commands or interfaces for programming the controller 12 via an external computer or mobile device.

The battery 14 powers the controller 12 and may be positioned in the battery compartment 38. The battery 14 may be any compact battery such as a button cell battery or a rechargeable battery. In one embodiment, two or more batteries may be used. In that case, the battery compartment 38 may include two or more battery chambers or recesses for positioning the batteries therein.

The antenna 16 transmits the beacon or tracking signal and may be an elongated wire extending from the housing 10. The antenna 16 may extend parallel to the longitudinal axis of the arrow shaft to minimize drag when the arrow is shot. The antenna 16 may also be configured to receive control or command signals from the hunter or another entity or position signals from a GPS. It will be understood that a circuit-mounted transceiver and a wire extending therefrom, or any other signal-emitting electronic component or components may be used.

The sleeve 18 retains the housing 10 on the arrow 100 and includes a primary body 48, an opening 50 extending through the primary body 48, a number of catches 52, and a number of elastic ring guides 54. The sleeve 18 may also include a battery contact tab 56. The primary body 48 may be a ring or clip configured to be positioned on or attached to the arrow shaft 104. The opening 50 receives the arrow shaft 104 therethrough and may be sized such that the sleeve 18 can be resistively attached to the arrow shaft 104. The catches 52 may be small protrusions, tabs, or other similar members for engaging the latches 42 of the flexible clips 30, 32. The elastic ring guides 54 retain the elastic ring 20 over the flexible clip 30 and may be shallow recesses or channels. To that end, the elastic ring guides 54 are configured to align with the elastic ring grooves 44 when the flexible clips 30, 32 engage the sleeve 18. The battery contact tab 56 extends from the sleeve 18 and may be configured to be inserted into the housing 10 so as to be positioned between the battery 14 and a battery contact or other circuit component when the housing 10 engages the sleeve 18. This prevents the battery from powering the controller 12 or otherwise discharging until the housing 10 is released from the sleeve 18.

The elastic ring 20 retains the housing 10 in engagement with the sleeve 18 via the latches 42 of the flexible clips 30, 32 and the catches 52 of the sleeve 18 and may be a rubber band, clip, or other elastic, flexible, or stretchable component. For example, the elastic ring 20 may be a rubber torus configured to be stretched onto the elastic ring guides 54 and the elastic ring grooves 44.

Each prong 22 extends forward from the housing 10 and may have a sharp, pointed end for piercing the game animal's hide and a sharp, pointed barb spaced from the end and pointed backwards for retaining the prong 22 in the game animal's hide. Each prong 22 may be formed of metal and may be removably attachable to the housing 10. In some embodiments, the animal tracking device 100 may include two or more prongs for ensuring that the housing 10 attaches to the game animal's hide.

Figure 5:
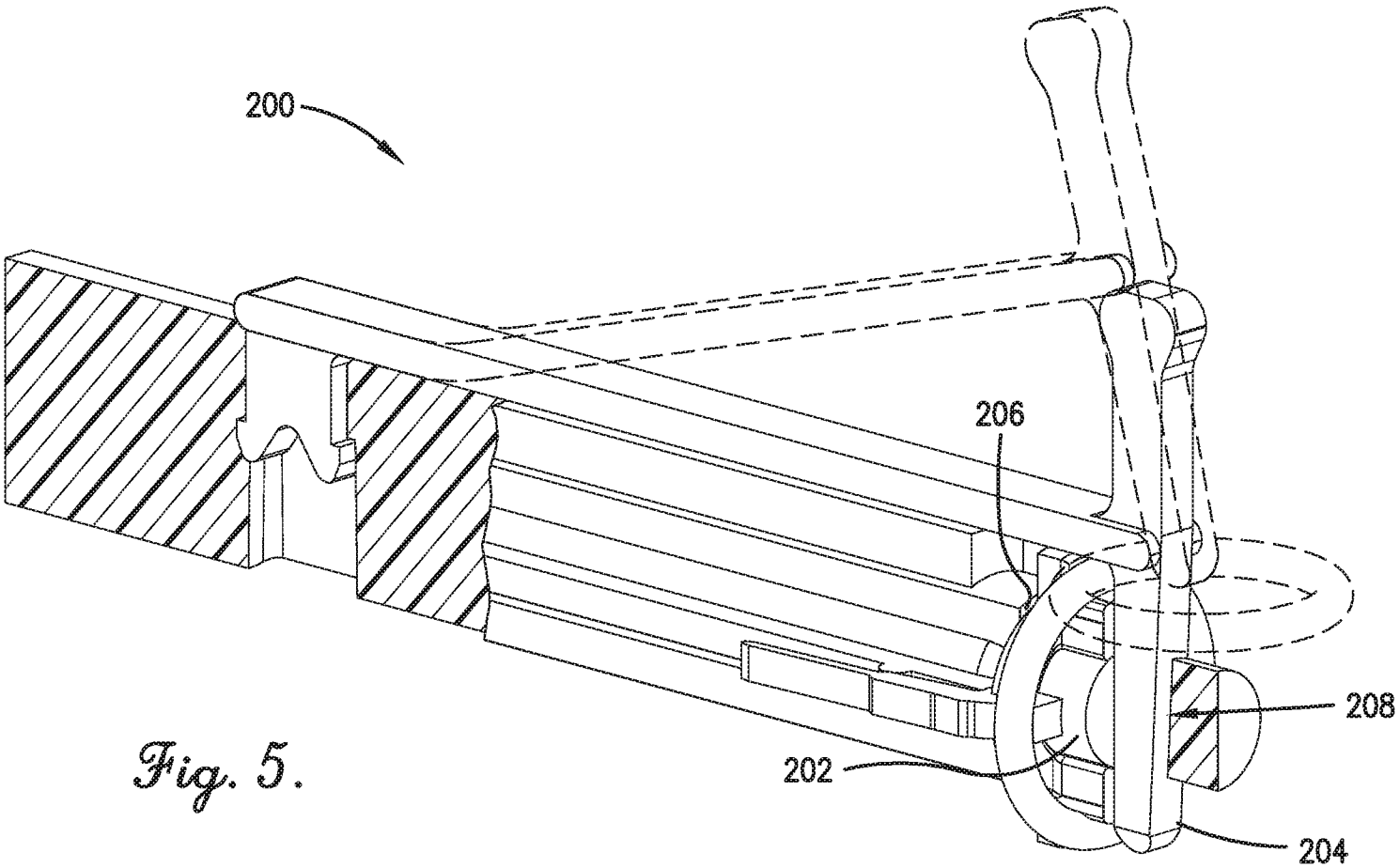
FIG. 5 is a perspective view of an animal tracking device assembling tool constructed in accordance with another embodiment of the invention.
Figure 6:
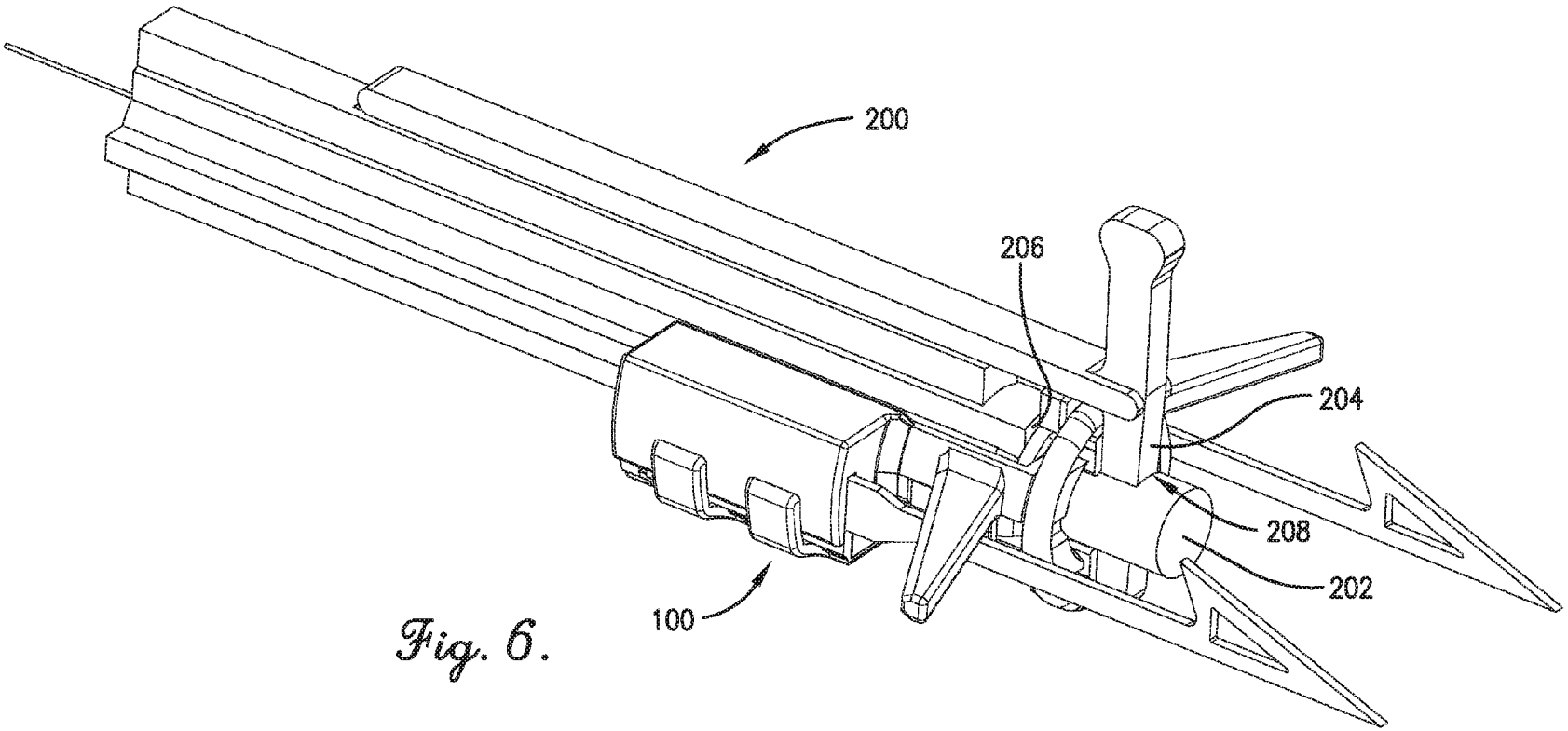
FIG. 6 is a perspective view of the animal tracking device assembling tool of FIG. 5 with the animal tracking device of FIG. 1 assembled thereon.

The assembling tool 200 assists the hunter in assembling the animal tracking device 100 and broadly comprises a guide shaft 202 and a retaining pin 204, as shown in FIGS. 5 and 6. The guide shaft 202 allows the hunter to temporarily place the sleeve 18 thereon and includes a retaining lip 206 and a retaining pin opening 208. The retaining lip 206 extends radially on the guide shaft 202 and ensures that the sleeve 18 is correctly positioned on the guide shaft 202. The retaining pin opening 208 extends into and/or through the guide shaft 202 and receives a portion of the retaining pin 204 therein. The retaining pin 204 retains the sleeve 18 on the guide shaft 202 and is configured to be inserted into the retaining pin opening 208.

Use of the animal tracking device 100 and the assembling tool 200 will now be described in more detail and with reference to FIGS. 5 and 6. First, the guide shaft 202 may be inserted through the opening 50 of the sleeve 18 until the sleeve 18 rests against the retaining lip 206. The retaining pin 204 may then be positioned in the retaining pin opening 208 to hold the sleeve 18 on the guide shaft 202. The retaining pin 204 may also be connected to the guide shaft 202 via a clip or latch. The housing 10 may then be slid over or on the guide shaft 202 until the latches 42 of the flexible clips 30, 32 engage the catches 52 of the sleeve 18. The elastic ring 20 may then be positioned on the elastic ring grooves 44 of the flexible clips 30, 32 and the elastic ring guides 54 of the sleeve 18 so as to retain the housing 10 in engagement with sleeve 18. The retaining pin 204 may then be removed from the retaining pin opening 208. The guide shaft 202 may then be removed from the sleeve 18. The arrow shaft 104 may then be inserted through the opening 50 of the sleeve 18 such that the housing 10 is positioned adjacent to the arrow shaft 104 and the prongs 22 extend forward and parallel to the arrow shaft 104. The arrow head 106 of the arrow 102 may then be connected to the arrow shaft 104 so that the animal tracking device 100 is attached to the arrow 102.

The arrow 102 may then be shot at a game animal such as a deer or elk. Shortly after the arrow 102 pierces the hide of the game animal, the prongs 22 of the animal tracking device 100 will pierce and become embedded in the hide of the game animal. However, the latch release members 46 will catch on the hide of the game animal and the hide will exert a reactive or bending force against the latch release members 46. The force exerted on the latch release members 46 will bend the flexible clips 30, 32 away from the arrow shaft 104 at their flexible necks 40 so as to overcome tension in the elastic ring 20. The flexible clips 30, 32 will continue bending away from the arrow shaft 104 until the latches 42 of the flexible clips 30, 32 become disengaged from the catches 52 of the sleeve 18. The battery contact tab 56 of the sleeve 18 may then slide out of the battery compartment 38, thus allowing the battery 14 to come into contact with a battery connection, thus completing a circuit with the controller 12. The controller 12 may then begin generating tracking signals and transmitting them via the antenna 16. The arrow 102 and the sleeve 18 may then continue through the hide of the game animal and may even pass through the game animal completely. However, the housing 10 and tracking circuitry will remain attached to the hide of the game animal via the prongs 22. The hunter may receive the tracking signals via a mobile computing device or other receiver and may follow the tracking signals until the game animal expires or becomes exhausted.

It will be understood that the animal tracking device 100 may be used with an arrow 102 or "bolt" shot from a bow, crossbow, slingshot, or other arrow launcher such as an air-powered arrow gun. The animal tracking device 100 may also be used with a tranquilizer dart or other projectile.

The above-describe animal tracking device 100 and assembling tool 200 provide several advantages over conventional animal tracking devices. For example, the housing 10 and tracking circuitry of the animal tracking device 100 remain attached to the hide of the game animal even if the arrow 102 passes through and does not remain with the game animal. The housing 10 and tracking circuitry of the animal tracking device 100 also remain outside of the hide of the game animal, which may improve signal quality and may reduce wear and tear received by the animal tracking device 100. The controller compartment 36 and the battery compartment 38 are positioned on opposite sides of the housing 10 such that weight of the animal tracking device 100 is distributed more evenly around the arrow 102. The assembling tool 200 also significantly simplifies assembling the animal tracking device 100 on the arrow 102.

Having thus described various embodiments of the invention, what is claimed as new and desired to be protected by Letters Patent includes the following:

1. An animal tracking device, the animal tracking device comprising:

a housing configured to be positioned adjacent a shaft of an arrow, the housing comprising a flexible clip extending from a first end of the housing, the flexible clip including:

a flexible neck;

an inner side including a latch;

an outer side opposite the inner side, the outer side having an elastic ring groove; and a latch release member extending from the outer side between the flexible neck and the elastic ring groove;

a controller positioned in the housing and configured to generate a tracking signal;

an antenna extending from the housing for emitting the tracking signal;

a sleeve configured to engage the latch of the flexible clip;

an elastic ring configured to be positioned over the sleeve and aligned with the elastic ring groove of the flexible clip for resistively retaining the latch in engagement with the sleeve such that the housing is removably attached to the arrow shaft; and a prong extending from the housing for piercing the animal's hide and attaching the animal tracking device to the animal when the arrow hits the animal, the latch release member being configured to catch on the animal's hide when the arrow hits the animal and slightly bend the flexible clip at the flexible neck against a resistive force exerted by the elastic ring until the latch of the flexible clip clears the sleeve so as to free the housing from the sleeve and the arrow shaft such that the animal tracking device remains attached to the animal via the prong.

2. The animal tracking device of claim 1, wherein the sleeve comprises:

a primary body;

an opening extending through the primary body for positioning the sleeve on the arrow shaft;

a catch for releasibly engaging the latch of the flexible clip; and an elastic ring guide extending from the primary body for receiving the elastic ring therein.

3. The animal tracking device of claim 1, further comprising a battery positioned in the housing, the battery being configured to power the controller, the sleeve further comprising a tab extending therefrom, the tab being configured to electronically isolate the battery such that the battery does not power the controller when the housing is retained on the arrow shaft.

4. The animal tracking device of claim 1, the prong being removably attachable to the housing.

5. The animal tracking device of claim 1, the prong extending beyond the flexible clip.

6. The animal tracking device of claim 1, further comprising a second prong spaced from the first prong.

7. The animal tracking device of claim 1, the housing being formed of molded plastic.

8. An animal tracking device comprising:

a housing configured to be positioned adjacent a shaft of an arrow, the housing comprising:

a controller compartment; and at least two flexible clips extending from a first end of the housing, the at least two flexible clips each including:

a flexible neck;

an inner side including a latch;

an outer side opposite the inner side, the outer side having an elastic ring groove; and a latch release member extending from the outer side between the flexible neck and the elastic ring groove;

a controller positioned in the controller compartment of the housing, the controller being configured to generate a tracking signal;

an antenna extending from the housing for emitting the tracking signal;

a sleeve configured to engage the latches of the flexible clips, the sleeve comprising:

a primary body;

an opening extending through the primary body for positioning the sleeve on the arrow shaft;

at least two catches extending from the primary body for releasibly engaging the latches of the at least two flexible clips; and at least two sets of elastic ring guides extending from the primary body;

an elastic ring configured to be positioned in the elastic ring guides and aligned with the elastic ring grooves of the flexible clips for resistively retaining the latches in engagement with the at least two catches of the sleeve such that the housing is removably attached to the arrow shaft; and a prong extending from the housing for piercing the animal's hide and attaching the animal tracking device to the animal when the arrow hits the animal, the latch release members being configured to catch on the animal's hide when the arrow hits the animal and slightly bend the flexible clips at their flexible necks against a resistive force exerted by the elastic ring until the latches of the flexible clips clear the catches of the sleeve so as to free the housing from the sleeve and the arrow shaft such that the animal tracking device remains attached to the animal via the prong.

9. The animal tracking device of claim 8, further comprising a battery configured to power the controller, the housing comprising a first section including the controller compartment, a second section spaced from the first section and including a battery compartment configured to retain the battery therein, and a connecting member extending between the first section and the second section on one side of the housing so that the housing is C-shaped, the animal tracking device further comprising a wire extending from the battery to the controller along the connecting member.

10. The animal tracking device of claim 9, the housing further comprising a cover for enclosing the wire.

11. The animal tracking device of claim 8, the flexible clips being positioned opposite each other and the catches of the sleeve being positioned opposite each other.

12. An animal tracking device comprising:

a housing configured to be positioned adjacent the arrow shaft, the housing comprising at least two flexible clips extending from a first end of the housing, the at least two flexible clips each including:

a flexible neck;

an inner side including a latch;

an outer side opposite the inner side, the outer side having an elastic ring groove; and a latch release member extending from the outer side between the flexible neck and the elastic ring groove;

a controller positioned in the housing and configured to generate a tracking signal;

an antenna extending from the housing for emitting the tracking signal;

a sleeve configured to engage the latches of the flexible clips, the sleeve comprising:

a primary body;

an opening extending through the primary body for positioning the sleeve on the arrow shaft;

at least two catches extending from the primary body for releasibly engaging the latches of the at least two flexible clips; and at least two sets of elastic ring guides extending from the primary body;

an elastic ring configured to be positioned in the elastic ring guides and aligned with the elastic ring grooves of the flexible clips for resistively retaining the latches in engagement with the at least two catches of the sleeve such that the housing is removably attached to the arrow shaft; and a prong extending from the housing for piercing the animal's hide and attaching the animal tracking device to the animal when the arrow hits the animal, the latch release members being configured to catch on the animal's hide when the arrow hits the animal and slightly bend the flexible clips at their flexible necks against a resistive force exerted by the elastic ring until the latches of the flexible clips clear the catches of the sleeve so as to free the housing from the sleeve and the arrow shaft such that the animal tracking device remains attached to the animal via the prong.

13. The animal tracking device of claim 12, further comprising a battery configured to power the controller and a battery contact, the sleeve further comprising a tab extending therefrom, the tab being configured to be positioned between the battery and the battery contact such that the battery does not power the controller when the housing is retained on the arrow shaft.

14. The animal tracking device of claim 13, the housing further comprising:

a first section having a controller compartment for retaining the controller therein;

a second section spaced from the first section having a battery compartment for retaining the battery therein; and a connecting member extending between the first section and the second section.

15. The animal tracking device of claim 14, further comprising a wire extending from the battery to the controller along the connecting member.

16. The animal tracking device of claim 12, the flexible clips being positioned opposite each other and the catches of the sleeve being positioned opposite each other.

17. The animal tracking device of claim 12, the prong being connected to the first section, the animal tracking device further comprising a second prong connected to the second section.

18. The animal tracking device of claim 17, the prongs being detachable from the housing.

19. The animal tracking device of claim 17, the prongs extending beyond the flexible clips.

20. The animal tracking device of claim 17, the latch release members extending diagonally forward from the housing.

* * * * *